US007833390B2

(12) United States Patent
Shyu

(10) Patent No.: US 7,833,390 B2
(45) Date of Patent: Nov. 16, 2010

(54) ELECTROLYZER HAVING RADIAL FLOWING PASSAGE

(76) Inventor: Wen Shing Shyu, No. 80, Tsauguei 1st Street, Situn, Taichung 40755 (TW)

( * ) Notice: Subject to any disclaimer, the term of this patent is extended or adjusted under 35 U.S.C. 154(b) by 1129 days.

(21) Appl. No.: 11/435,457

(22) Filed: May 16, 2006

(65) Prior Publication Data

US 2007/0267296 A1 Nov. 22, 2007

(51) Int. Cl.
*C25B 9/00* (2006.01)
*C25B 1/34* (2006.01)
*C02F 1/461* (2006.01)

(52) U.S. Cl. ..... 204/252

(58) Field of Classification Search ..... None
See application file for complete search history.

(56) References Cited

U.S. PATENT DOCUMENTS 4,125,439 A * 11/1978 Fleischmann et al. ..... 205/639
4,342,636 A 8/1982 Chang et al. ..... 204/296
4,457,813 A * 7/1984 Rogers et al. ..... 205/415
4,761,208 A * 8/1988 Gram et al. ..... 210/748
4,885,142 A * 12/1989 Suitor et al. ..... 205/634
5,308,507 A * 5/1994 Robson ..... 210/748
5,534,120 A * 7/1996 Ando et al. ..... 205/464
5,556,523 A * 9/1996 Satoh et al. ..... 204/272
6,328,875 B1 * 12/2001 Zappi et al. ..... 205/500

* cited by examiner

*Primary Examiner*—Harry D Wilkins, III
(74) *Attorney, Agent, or Firm*—Charles E. Baxley

(57) ABSTRACT

An electrolyzer includes a housing having a space for receiving an electrolytic solution, and a cathode plate and an anode plate disposed in the housing and disposed horizontally and arranged one above the other and spaced from each other for forming a gap between the anode plate and the cathode plate, and arranged for guiding the electrolytic solution to flow radially through the gap formed between the anode plate and the cathode plate, and the cathode plate may attract catholyte of the electrolytic solution toward the cathode plate, and the anode plate may attract anolyte of the electrolytic solution toward the anode plate for allowing the anolyte and the catholyte to be separated from each other.

18 Claims, 10 Drawing Sheets

ELECTROLYZER HAVING RADIAL FLOWING PASSAGE

BACKGROUND OF THE INVENTION

1. Field of the Invention

The present invention relates to an electrolytic cell or electrolyzer, and more particularly to an electrolytic cell or electrolyzer having a radial flowing passage for suitably separating and collecting anolyte and catholyte from a flowing electrolyte or water, and for preventing the anolyte and the catholyte from being mixed or blended with each other.

2. Description of the Prior Art

Typical electrolytic cells or electrolyzers comprise one or more anodes and one or more cathodes disposed within a cell body or container that is provided for receiving electrolyte therein, for generating anolyte and catholyte by energizing or actuating or operating the anodes and the cathodes, and for utilizing the anolyte and the catholyte to electroplate various kinds of work pieces, for example.

In some circumstances, the anolyte and the catholyte are required to be separated from each other, for such as manufacturing or separating chlorine and caustic from brine. Accordingly, one or more separators or separating devices are required to be disposed or engaged into the electrolytic cells or electrolyzers for separating the anolyte and the catholyte from each other in the typical electrolytic cells.

For example, U.S. Pat. No. 4,342,636 to Chang et al. discloses one of the typical electrolytic cells including a porous polyfluoroalkylene sheet disposed therein and acted as a separator for the electrolysis of brine and for separating the anolyte and the catholyte from each other.

However, the typical porous polyfluoroalkylene sheet is good enough for separating the anolyte and the catholyte from each other in a static or motionless electrolyte in the electrolytic cells or electrolyzers, but the typical electrolytic cells or electrolyzers may not be used for separating and collecting the anolyte and the catholyte from the flowing electrolyte or water.

In addition, normally, the inlet ports of the typical electrolytic cells or electrolyzers include a cross section or area identical to the outlet ports of the typical electrolytic cells or electrolyzers for allowing the electrolyte or water to flow in the same flowing speed into and out of the typical electrolytic cells or electrolyzers, such that the outward flowing speed of the electrolyte or water may not be suitably decreased or slowed down.

The present invention has arisen to mitigate and/or obviate the afore-described disadvantages of the conventional electrolytic cells or electrolyzers for separating the anolyte and the catholyte from each other.

SUMMARY OF THE INVENTION

The primary objective of the present invention is to provide an electrolytic cell or electrolyzer having a radial flowing passage for suitably separating and collecting the anolyte and the catholyte from the flowing electrolyte and for preventing the anolyte and the catholyte from being mixed or blended with each other.

In accordance with one aspect of the invention, there is provided an electrolyzer comprising a housing including a space formed therein for receiving an electrolytic solution to be electrolyzed, and a cathode plate and an anode plate disposed in the space of the housing and disposed horizontally and arranged one above the other, and spaced from each other for forming a gap between the anode plate and the cathode plate, and arranged for guiding the electrolytic solution to flow radially through the gap formed between the anode plate and the cathode plate, and the cathode plate is provided for attracting catholyte of the electrolytic solution toward the cathode plate, and the anode plate is provided for attracting anolyte of the electrolytic solution toward the anode plate, and for allowing the anolyte and the catholyte to be separated from each other.

A separator may further be provided and disposed in the housing and disposed around the anode plate and the cathode plate, and includes a tip extended toward the gap that is formed between the anode plate and the cathode plate for separating the anolyte and the catholyte from each other.

A cover may further be provided and attached onto the housing for enclosing the space of the housing, and engaged with the separator for positioning the separator between the housing and the cover. The housing includes a peripheral channel formed therein, the cover includes a peripheral fence extended therefrom and engaged into the peripheral channel of the housing for securing the cover to the housing.

The cover includes a mouth for allowing the electrolytic solution to flow into and out of the space of the housing, and includes a compartment formed therein and includes a number of ribs extended into the compartment of the cover and extended radially from the mouth toward an outer peripheral portion of the cover.

A distributor may further be provided and disposed in the space of the housing, and the anode plate and the cathode plate are disposed above the distributor. The distributor includes at least one stud extended downwardly therefrom for engaging with the housing and for spacing the distributor from the housing.

The housing includes a cylindrical member extended downwardly therefrom and a bore formed therein and communicating with the space of the housing, the distributor includes a tube extended downwardly therefrom for engaging into the bore of the cylindrical member of the housing, and the tube includes a passage formed therein for allowing the electrolytic solution to flow through the passage of the tube.

The housing includes a number of ribs extended into the space of the housing and extended radially and outwardly from the bore of the cylindrical member, and the anode plate is disposed above the ribs of the housing for spacing the distributor from the housing by the ribs.

The housing includes at least one orifice formed therein, and the distributor includes at least one hole formed therein and aligned with the orifice of the housing, and the anode plate includes at least one electrode extended therefrom and engaged through the hole of the distributor and the orifice of the housing.

A receptacle may further be provided and includes a chamber formed therein and defined by an inner peripheral surface, and includes a first port and a second port formed therein and communicating with the chamber of the receptacle for allowing the electrolytic solution to flow into and out of the chamber of the receptacle, the cylindrical member of the housing and the tube of the distributor are engaged into the chamber of the receptacle.

The housing includes a head provided on the tube and engaged into the chamber of the receptacle, and a sealing ring engaged between the head of the tube and the receptacle for making a water tight seal between the distributor and the receptacle, and for separating the first port and the second port of the receptacle from each other.

The receptacle includes at least one lock notch formed therein, and the housing includes at least one latch extended outwardly from the cylindrical member for engaging with the lock notch of the receptacle and for detachably attaching the cylindrical member of the housing to the receptacle. The distributor includes at least one spine extended outwardly from the tube for engaging with the cylindrical member and for spacing the tube of the distributor from the cylindrical member.

The anode plate is disposed below the cathode plate and includes a center hole formed therein for allowing the electrolytic solution to flow into the gap which is formed between the anode plate and the cathode plate. The anode plate and the cathode plate include an outer peripheral portion spaced away from each other for decreasing a flowing speed of the electrolytic solution.

The cathode plate includes a recess formed therein and facing toward the center hole of the anode plate for buffering and guiding the electrolytic solution to flow through the gap which is formed between the anode plate and the cathode plate. The cathode plate include a curved barrier to form the recess of the cathode plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
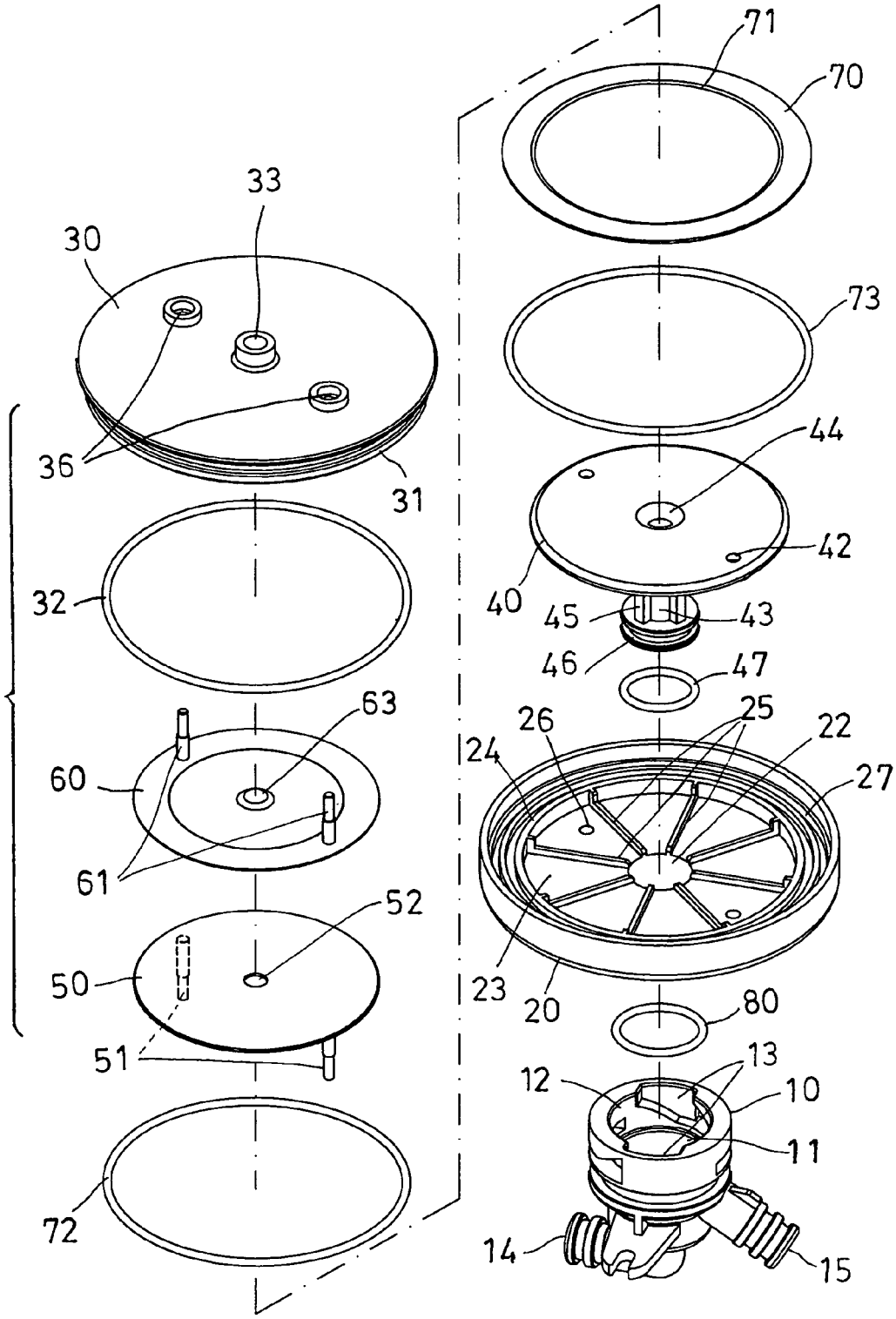
FIG. 1 is an exploded view of an electrolytic cell or electrolyzer in accordance with the present invention having a radial flowing passage.
Figure 2:
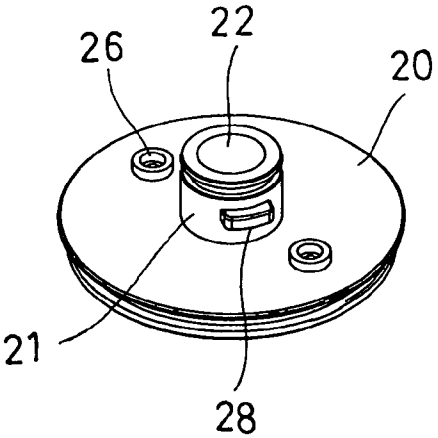
FIG. 2 is a bottom perspective view illustrating a lower housing of the electrolytic cell or electrolyzer.
Figure 3:
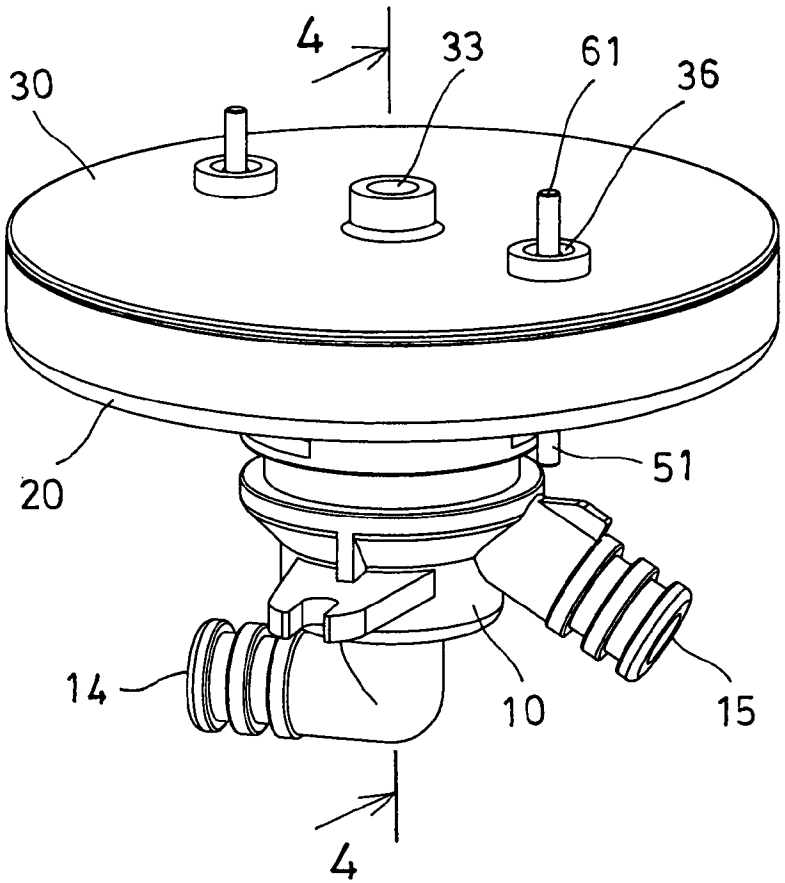
FIG. 3 is a perspective view of the electrolytic cell or electrolyzer.
Figure 4:
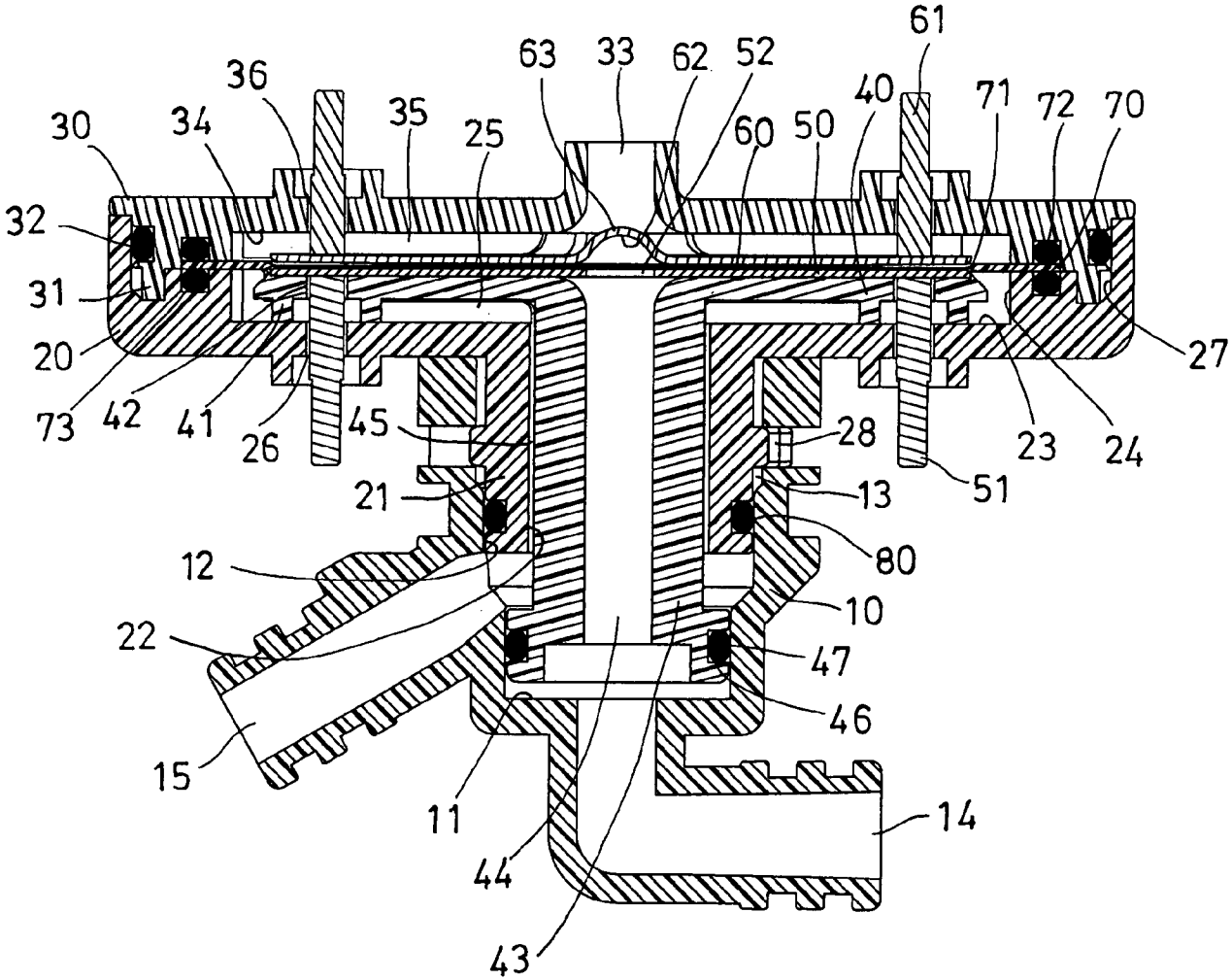
FIG. 4 is a cross sectional view of the electrolyzer taken along lines 4-4 of FIG. 3.

Referring to the drawings, and initially to FIGS. 1-4, an electrolytic cell or electrolyzer 1 in accordance with the present invention comprises a body or receptacle 10 including a chamber 11 formed therein and defined by an inner peripheral surface 12, and including one or more, such as two lock notches 13 formed in the inner peripheral surface 12 thereof and communicating with the chamber 11 of the receptacle 10, and including a first or inlet port 14 formed therein and communicating with the chamber 11 of the receptacle 10 for receiving such as water or brine or other electrolytic solutions, and further including a second or outlet port 15 formed therein and also communicating with the chamber 11 of the receptacle 10.

A housing 20, such as a lower housing 20 includes a sleeve or cylindrical member 21 extended downwardly therefrom for engaging into the chamber 11 of the receptacle 10 and having a bore 22 formed therein and communicating with the chamber 11 and the ports 14, 15 of the receptacle 10 (FIGS. 4, 5) and includes a space 23 formed therein and communicating with the bore 22 of the cylindrical member 21, and defined by a peripheral wall 24, and includes a number of radially extended ribs 25 extended into the space 23 of the housing 20 and extended from the outer peripheral portion of the bore 22 of the cylindrical member 21 to the peripheral wall 24 for guiding the electrolytic solution or water to flow from the space 23 into the bore 22 of the cylindrical member 21 of the housing 20.

The housing 20 further includes one or more, such as two orifices 26 formed therein and communicating with the space 23 of the housing 20, and includes a peripheral channel 27 formed in the outer peripheral portion thereof and located outside or around the peripheral wall 24. A sealing ring 80 may be provided and engaged between the receptacle 10 and the cylindrical member 21 of the housing 20 for making a water tight seal between the receptacle 10 and the housing 20. The housing 20 may include one or more latches 28 extended outwardly from the cylindrical member 21 (FIGS. 2, 4, 5) for engaging with the lock notches 13 of the receptacle 10 and for detachably securing or attaching or coupling the cylindrical member 21 of the housing 20 to the receptacle 10.

A cover 30 may be provided and engaged or attached onto the housing 20 for enclosing the space 23 of the housing 20, the cover 30 includes a peripheral fence 31 extended downwardly from the outer peripheral portion thereof for engaging onto or into the housing 20, such as for engaging into the peripheral channel 27 of the housing 20 with such as a force-fitted engagement, or by adhesive materials or by welding processes, and a sealing ring 32 may be provided and engaged between the peripheral fence 31 of the cover 30 and the housing 20 for making a water tight seal between the cover 30 and the housing 20. The cover 30 includes a mouth 33, such as an outlet mouth 33 formed therein, and includes a compartment 34 formed therein.

The cover 30 includes a number of radially extended ribs 35 extended into the compartment 34 of the cover 30 and extended from the outer peripheral portion of the mouth 33 of the cover 30 to the outer peripheral portion of the cover 30 for guiding the electrolytic solution or water to flow from the compartment 34 into the mouth 33 of the cover 30. The cover 30 further includes one or more, such as two apertures 36 formed therein and communicating with the compartment 34 of the cover 30, and aligned with the orifices 26 of the housing 20 respectively. The compartment 34 of the cover 30 and the space 23 of the housing 20 may thus be provided for receiving the electrolytic solution or water to be treated or to be electrolyzed.

A casing or distributor 40 is disposed above the housing 20 or engaged into the space 23 of the housing 20 and disposed above or engaged onto the ribs 25 of the housing 20, such that the distributor 40 may be suitably spaced from the housing 20 by the ribs 25, or the space 23 may be existed and will not be completely blocked by the distributor 40 and the housing 20. The distributor 40 may include one or more studs 41 extended downwardly therefrom for engaging with the housing 20 and for further suitably spacing the distributor 40 from the housing 20, and may include one or more holes 42 formed therein, such as formed in each of the studs 41 and aligned with the orifices 26 of the housing 20 and the apertures 36 of the cover 30 respectively.

The distributor 40 includes a tube 43 extended downwardly therefrom for engaging into the bore 22 of the cylindrical member 21 of the housing 20, and the tube 43 includes a bore or passage 44 formed therein and communicating with the chamber 11 and the first port 14 of the receptacle 10 (FIGS. 4, 5), and includes one or more spines 45 extended outwardly from the tube 43 for engaging with the cylindrical member 21 and for suitably spacing the tube 43 of the distributor 40 from the cylindrical member 21. It is preferable that the distributor 40 includes an enlarged head 46 extended or provided on the lower portion of the tube 43 and engaged into the bottom portion of the chamber 11 of the receptacle 10, and a further sealing ring 47 is provided and engaged between the head 46 of the tube 43 or of the distributor 40 and the receptacle 10 for making a water tight seal between the distributor 40 and the receptacle 10.

The tube 43 and/or the head 46 of the distributor 40 may thus be used to separate the first port 14 and the second or outlet port 15 of the receptacle 10 from each other, and the first port 14 of the receptacle 10 and the passage 44 of the tube 43 or of the distributor 40 may thus be sealed and connected or communicated with each other for receiving the electrolytic solution or water that flows into the first port 14 of the receptacle 10. The bore 22 of the cylindrical member 21 and the space 23 of the housing 20 and the second or outlet port 15 of the receptacle 10 may also be sealed and connected or communicated with each other for allowing the electrolytic solution or water, or the anolyte or the catholyte to flow from the space 23 of the housing 20 to the second or outlet port 15 of the receptacle 10.

An anode plate 50 is disposed or engaged into the space 23 of the housing 20 and disposed or engaged onto or seated or supported on the upper portion of the distributor 40 (FIGS. 4-6), and includes one or more, such as two electrodes 51, such as positive electrodes 51, extended therefrom for engaging through the holes 42 of the distributor 40 and through the orifices 26 of the housing 20 respectively and for coupling to such as the electric power source, and includes a center hole 52 formed therein and aligned with the passage 44 of the tube 43 or of the distributor 40 for allowing the electrolytic solution or water to flow upwardly through the center hole 52 of the anode plate 50 and thus for allowing the electrolytic solution or water to be treated or electrolyzed by the anode plate 50.

A cathode plate 60 is disposed or engaged into the space 23 of the housing 20 or into the compartment 34 of the cover 30 and disposed or engaged onto or seated on the bottom portion of the ribs 35 of the cover 30 and includes one or more, such as two electrodes 61, such as negative electrodes 61, extended therefrom for engaging through the apertures 36 of the cover 30 respectively and for coupling to such as the electric power source, and includes a recess 62 formed therein and defined by a curved barrier 63 and facing toward and aligned with the center hole 52 of the anode plate 50 and the passage 44 of the tube 43 or of the distributor 40 for allowing the electrolytic solution or water to be buffered or guided to flow through a gap 64 that is formed between the anode plate 50 and the cathode plate 60.

It is to be noted that the electrolytic solution or water flowing through the center hole 52 of the anode plate 50 may be buffered by the recess 62 of the cathode plate 60 and may then be guided to flow through the gap 64 that is formed between the anode plate 50 and the cathode plate 60 and to flow radially from the center portions the anode plate 50 and the cathode plate 60 toward the outer peripheral portion of the anode plate 50 and the cathode plate 60, such that the flowing speed of the electrolytic solution may be gradually decreased or slowed down from the center portions toward the outer peripheral portion of the anode plate 50 and the cathode plate 60 for preventing an eddy current from being generated between the anode plate 50 and the cathode plate 60.

It is preferable that the outer peripheral portion of the anode plate 50 may be slightly bent or tilted downwardly or further spaced away from the cathode plate 60, and/or the outer peripheral portion of the cathode plate 60 may be slightly bent or tilted upwardly or further spaced away from the anode plate 50 for further increasing the volume between the outer peripheral portion of the anode plate 50 and the cathode plate 60 and for further decreasing the flowing speed of the electrolytic solution and thus for further preventing the eddy current from being generated between the anode plate 50 and the cathode plate 60, and thus for allowing the electrolytic solution to smoothly flow through the gap 64 that is formed between the anode plate 50 and the cathode plate 60.

Figure 5:
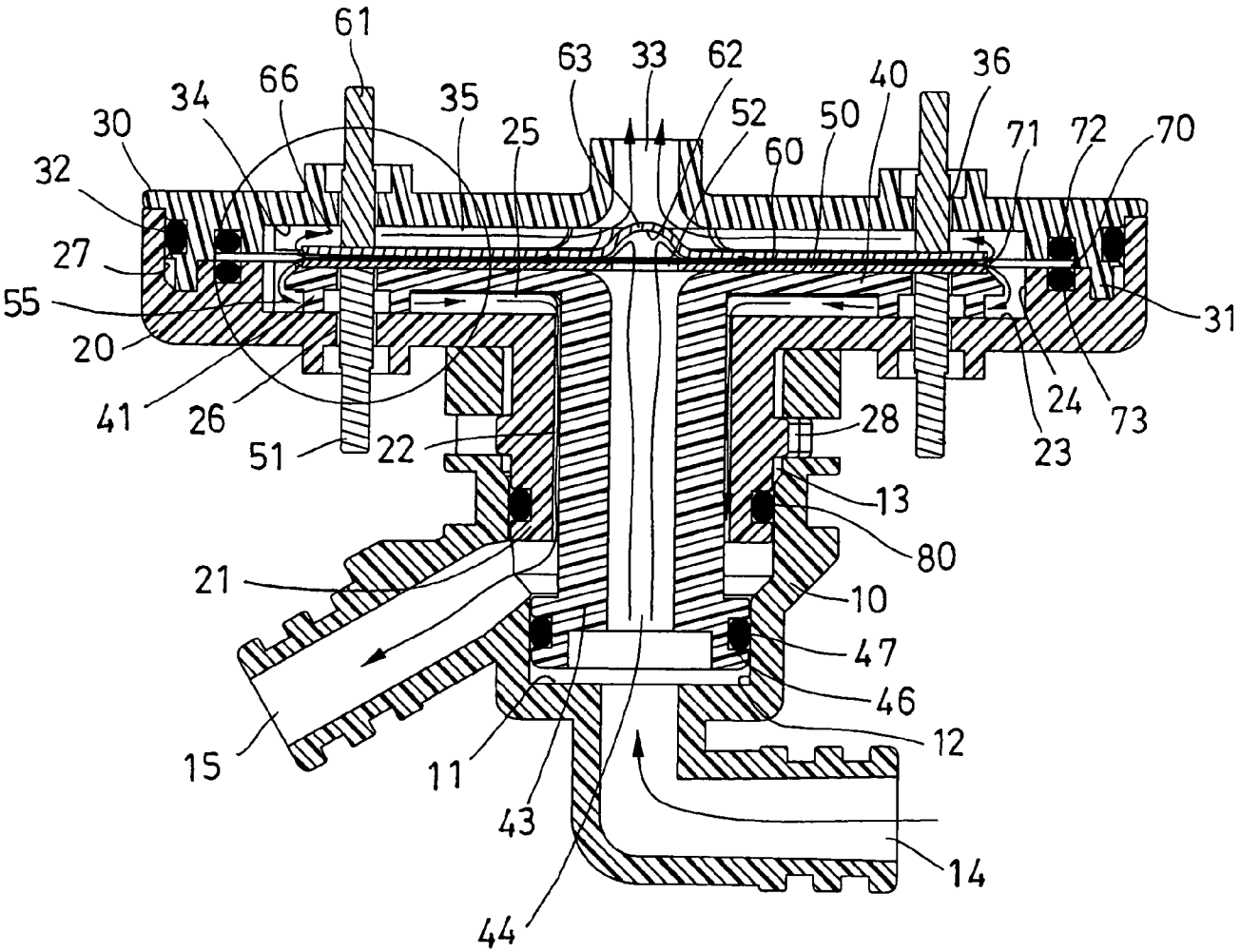
FIG. 5 is a cross sectional view similar to FIG. 4, illustrating the operation of the separating device.

In operation, as shown in FIG. 5, the electrolytic solution may be supplied and flown into the receptacle 10 via the inlet port 15 of the receptacle 10, and then flown through the passage 44 of the tube 43 or of the distributor 40 and the center hole 52 of the anode plate 50 and then buffered and guided to flow through the gap 64 that is formed between the anode plate 50 and the cathode plate 60 by such as the recess 62 of the cathode plate 60. When the cathode plate 60 and the anode plate 50 are energized or actuated or operated, the catholyte 66 may be generated and attracted toward the cathode plate 60 and may thus be forced or attracted to flow closer to the cathode plate 60 (FIG. 6), and the anolyte 55 may be generated and attracted toward the anode plate 50 and may thus be forced or attracted to flow closer to the anode plate 50 (FIG. 6).

Figure 6:
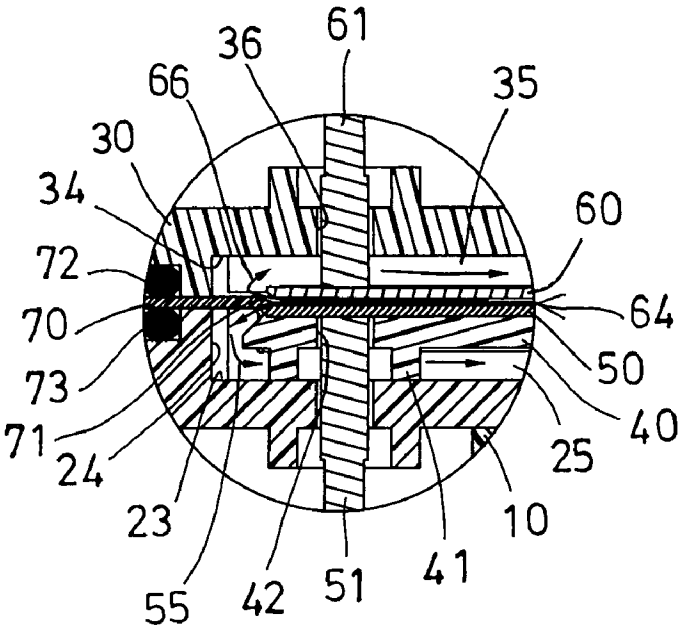
FIG. 6 is an enlarged partial cross sectional view of the electrolyzer as that shown in FIGS. 4 and 5.

An annular separator 70 may further be provided and disposed or secured between the cover 30 and the housing 20 and disposed around the anode plate 50 and the cathode plate 60, and includes a tip 71, such as an inner peripheral tip 71 extended into the space 23 of the housing 20 or extended into the compartment 34 of the cover 30 and extended toward the gap 64, such as toward the middle or intermediate portion of the gap 64 that is formed between the anode plate 50 and the cathode plate 60, best shown in FIG. 6, for suitably separating the catholyte 66 and the anolyte 55 from each other and for preventing the catholyte 66 and the anolyte 55 from being mixed or blended with each other. Two sealing rings 72, 73 may further be provided and engaged between the cover 30 and the housing 20 and the separator 70 for making a water tight seal between the cover 30 and the housing 20 and the separator 70.

In operation, as also shown in FIGS. 5 and 6, the catholyte 66 may be generated and attracted toward the cathode plate 60 and may thus be forced or caused or attracted to flow closer to the cathode plate 60, and may then be guided to flow into the compartment 34 of the cover 30 by the cathode plate 60 itself and/or by the separator 70 and to flow through the space between the cover 30 and the cathode plate 60, and may then be guided to flow out through the outlet mouth 33 of the cover 30, and then for allowing the catholyte 66 to be collected for further use.

Simultaneously, the anolyte 55 may be generated and attracted toward the anode plate 50 and may thus be forced or caused to flow closer to the anode plate 50, and may then be guided to flow into the space 23 of the housing 20 by the anode plate 50 itself and/or by the separator 70 and may then be guided to flow from the space 23 into the bore 22 of the cylindrical member 21 of the housing 20, and then to flow out of the receptacle 10 via the second or outlet port 15 of the receptacle 10, for allowing the anolyte 55 to be collected for further use.

The cathode plate 60 and the anode plate 50 may thus be used for generating the catholyte 66 and the anolyte 55 respectively, and for guiding the anolyte 55 to flow into the space 23 of the housing 20 and the bore 22 of the cylindrical member 21 and then to flow out through the second or outlet port 15 of the receptacle 10, and for guiding the catholyte 66 to flow into the compartment 34 of the cover 30 and then to flow out through the outlet mouth 33 of the cover 30. The tip 71 or the separator 70 may thus be acted as a separating means or device for separating the catholyte 66 and the anolyte 55 away from each other, and for effectively guiding the anolyte 55 and the catholyte 66 to flow into the space 23 of the housing 20 and the compartment 34 of the cover 30 respectively.

Figure 7:
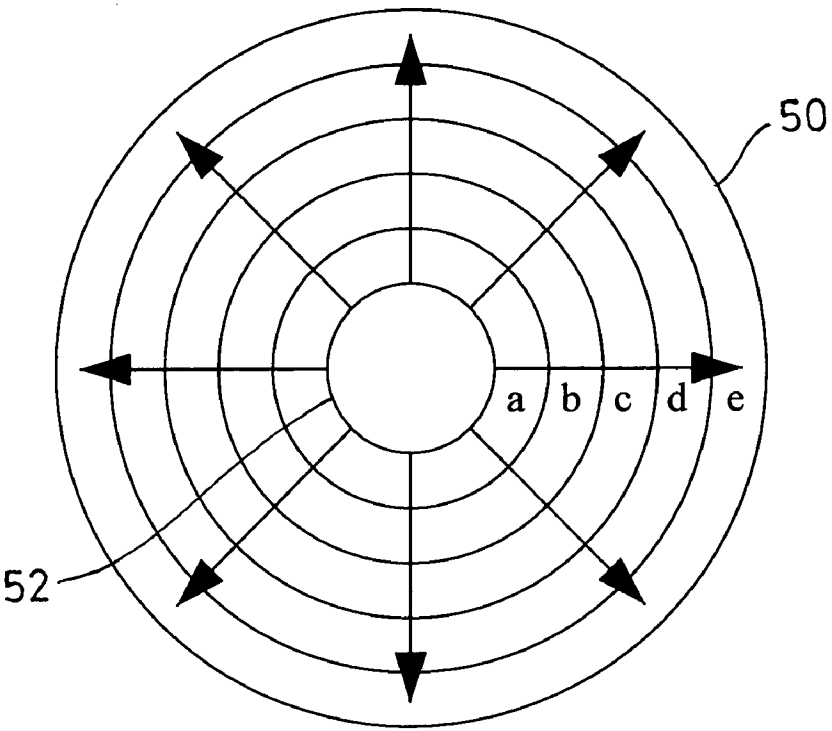
FIG. 7 is a partial top plan schematic view illustrating the flowing of the electrolyte or water.
Figure 8:
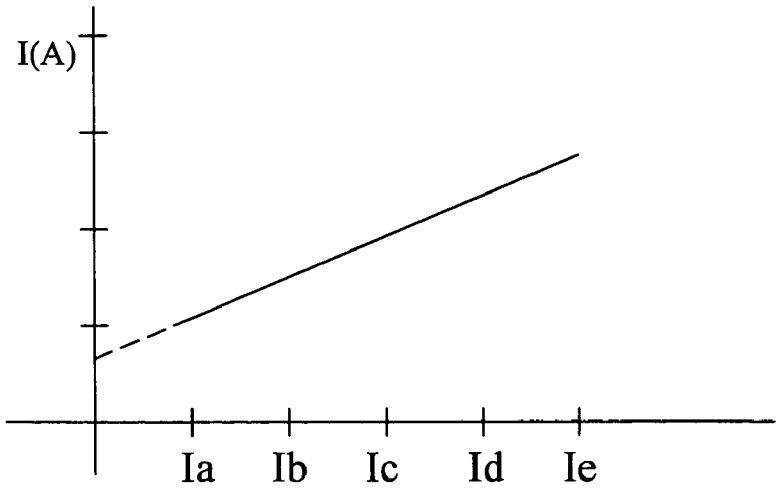
FIG. 8 is a diagram illustrating the changing of the electric current of the flowing electrolyte or water.
Figure 9:
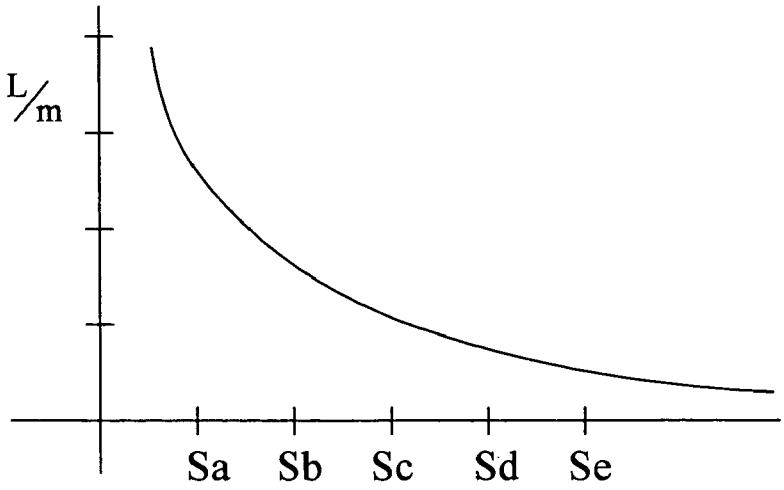
FIG. 9 is a diagram illustrating the changing of the flowing speed of the flowing electrolyte or water.

As shown in FIGS. 7-9, the catholyte 66 and the anolyte 55 or the electrolytic solution may be forced to flow radially from the center portion the anode plate 50 and the cathode plate 60 toward the outer peripheral portion of the anode plate 50 and the cathode plate 60, such that the flowing speed of the electrolytic solution may be gradually slowed down or decreased from the center portion toward the outer peripheral portion of the anode plate 50 and the cathode plate 60, and the skin effect (L/M) Sa, Sb, Sc, Sd, Se . . . may also be gradually decreased from the center portion toward the outer peripheral portion of the anode plate 50 and the cathode plate 60 (FIG. 9), and the electric current (I) Ia, Ib, Ic, Id, Ie . . . may be gradually increased from the center portion toward the outer peripheral portion of the anode plate 50 and the cathode plate 60 (FIG. 8).

Figure 10:
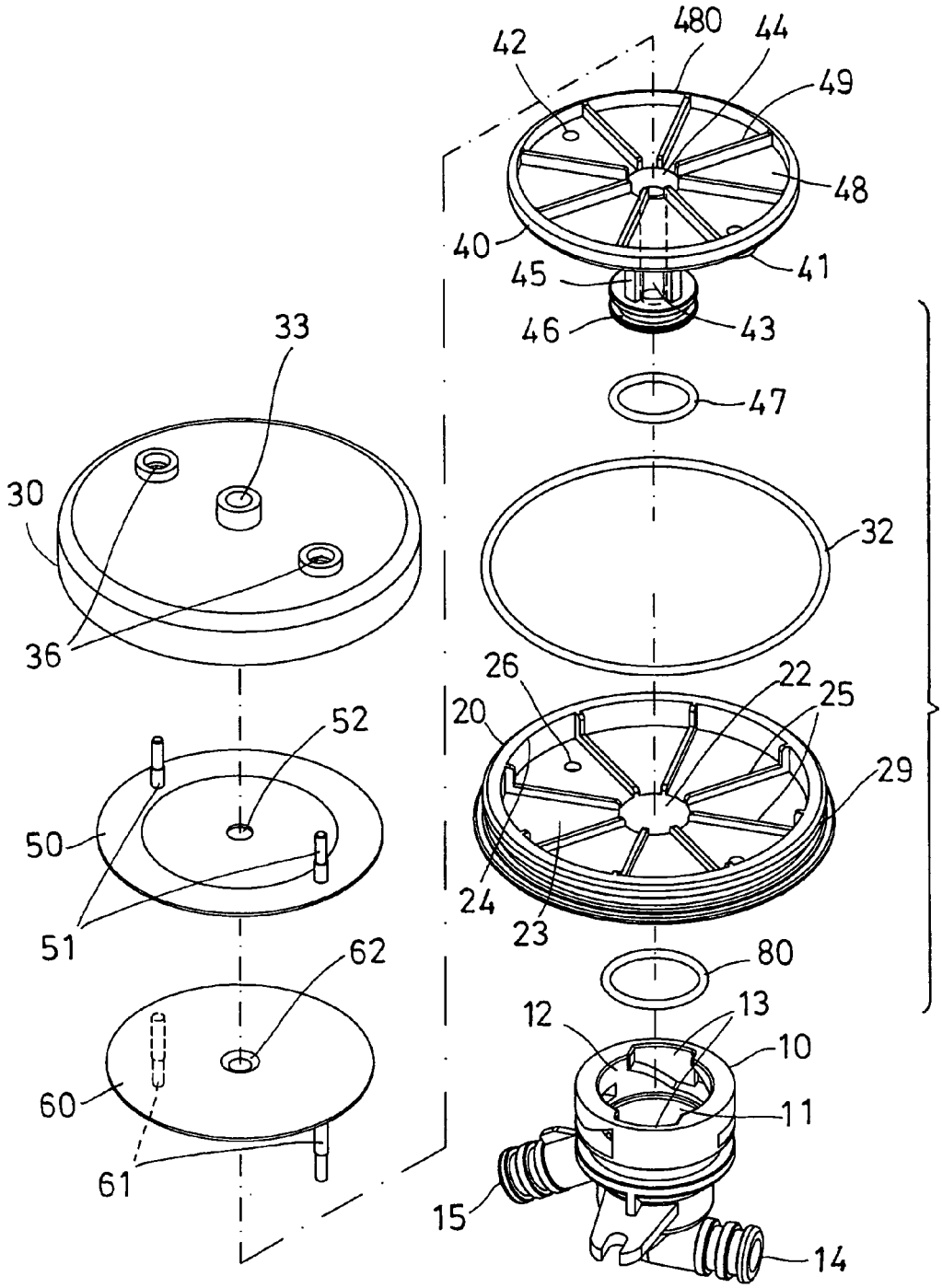
FIG. 10 is an exploded view similar to FIG. 1, illustrating the other arrangement of the electrolyzer.
Figure 11:
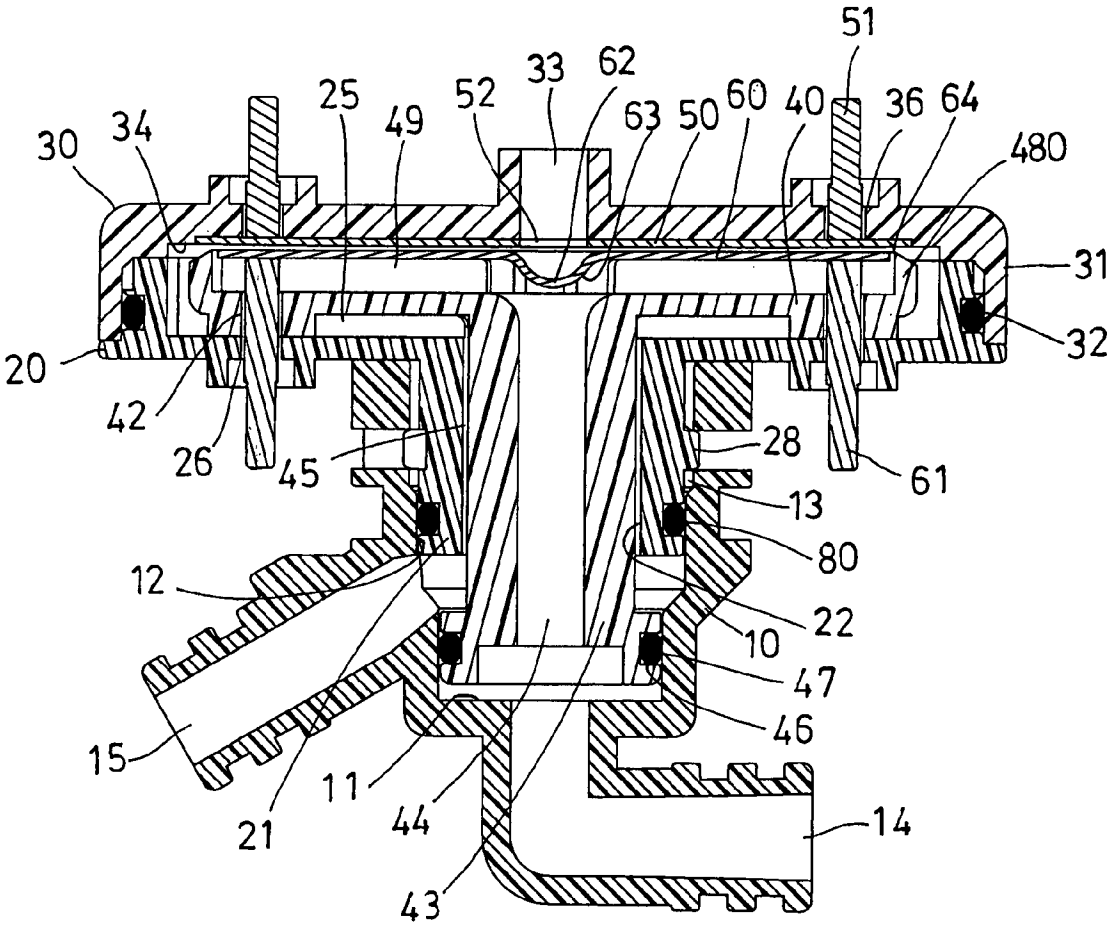
FIG. 11 is a cross sectional view of the electrolyzer as shown in FIG. 10.

Alternatively, as shown in FIGS. 10-11, the housing 20 may also include a sleeve or cylindrical member 21 extended downwardly therefrom for engaging into the chamber 11 of the receptacle 10 and also includes a space 23 communicating with the bore 22 of the cylindrical member 21 and defined by a peripheral wall 24, and includes a number of radially extended ribs 25 extended into the space 23 of the housing 20 for guiding the electrolytic solution or water to flow from the space 23 into the bore 22 of the cylindrical member 21 of the housing 20. A cover 30 may also be secured onto the housing 20 with such as a threaded engagement 29, and also includes a mouth 33, such as an inlet mouth 33 formed therein for receiving such as water or brine or other electrolytic solutions, and includes a compartment 34 formed therein.

A casing or distributor 40 is also disposed above the housing 20 or engaged into the space 23 of the housing 20 and disposed above or engaged onto the ribs 25 of the housing 20, and includes one or more holes 42 aligned with the orifices 26 of the housing 20 and the apertures 36 of the cover 30 respectively, and includes a tube 43 extended and engaged into the bore 22 of the cylindrical member 21 of the housing 20 and having a bore or passage 44 communicating with the first port 14 of the receptacle 10 (FIGS. 11, 12), and includes one or more spines 45 extended outwardly from the tube 43 for engaging with the cylindrical member 21 and for suitably spacing the tube 43 of the distributor 40 from the cylindrical member 21, and an enlarged head 46 extended from the tube 43.

A sealing ring 47 may also be engaged between the head 46 of the tube 43 or of the distributor 40 and the receptacle 10 for making a water tight seal between the distributor 40 and the receptacle 10. The tube 43 and/or the head 46 of the distributor 40 may also be used to separate the first or outlet port 14 and the second or outlet port 15 of the receptacle 10 from each other. The bore 22 of the cylindrical member 21 and the space 23 of the housing 20 and the second or outlet port 15 of the receptacle 10 may also be sealed and connected or communicated with each other for allowing the electrolytic solution or water, or the anolyte or the catholyte to flow from the space 23 of the housing 20 to the second or outlet port 15 of the receptacle 10.

The distributor 40 further includes a compartment 48 formed therein and defined by an outer peripheral partition 480, and a number of radially extended ribs 49 extended into the compartment 48 of the distributor 40 and extended from the outer peripheral portion of the passage 44 of the tube 43 or of the distributor 40 to the outer peripheral partition 480 of the distributor 40 for guiding the electrolytic solution or the catholyte or the anolyte to flow from the compartment 48 into the passage 44 of the tube 43 or of the distributor 40, and then to flow out through one of the outlet ports 14 of the receptacle 10.

The anode plate 50 is disposed or engaged into the compartment 34 of the cover 30 and disposed or engaged onto or seated on the bottom portion of the cover 30 and includes one or more, such as two electrodes 51, such as positive electrodes 51, extended therefrom for engaging through the apertures 36 of the cover 30 respectively and for coupling to such as the electric power source, and includes a center hole 52 formed therein and aligned with the mouth 33 of the cover 30. The cathode plate 60 is disposed or engaged onto or seated on the ribs 49 of the distributor 40 (FIGS. 11-13), and includes one or more, such as two electrodes 61, such as negative electrodes 61, extended therefrom for engaging through the holes 42 of the distributor 40 and through the orifices 26 of the housing 20 respectively and for coupling to such as the electric power source.

The cathode plate 60 includes a recess 62 formed therein and defined by a curved barrier 63 and facing upwardly toward and aligned with the center hole 52 of the anode plate 50 for allowing the electrolytic solution or water from the inlet mouth 33 of the cover 30 and through the center hole 52 of the anode plate 50 to be guided to flow through a gap 64 that is formed between the anode plate 50 and the cathode plate 60. The electrolytic solution or water flowing through the center hole 52 of the anode plate 50 may also be buffered by the recess 62 of the cathode plate 60 and may then be guided to flow through the gap 64 that is formed between the anode plate 50 and the cathode plate 60 and to flow radially from the center portions the anode plate 50 and the cathode plate 60 toward the outer peripheral portion of the anode plate 50 and the cathode plate 60, such that the flowing speed of the electrolytic solution may also be gradually decreased or slowed down from the center portions toward the outer peripheral portion of the anode plate 50.

Figure 12:
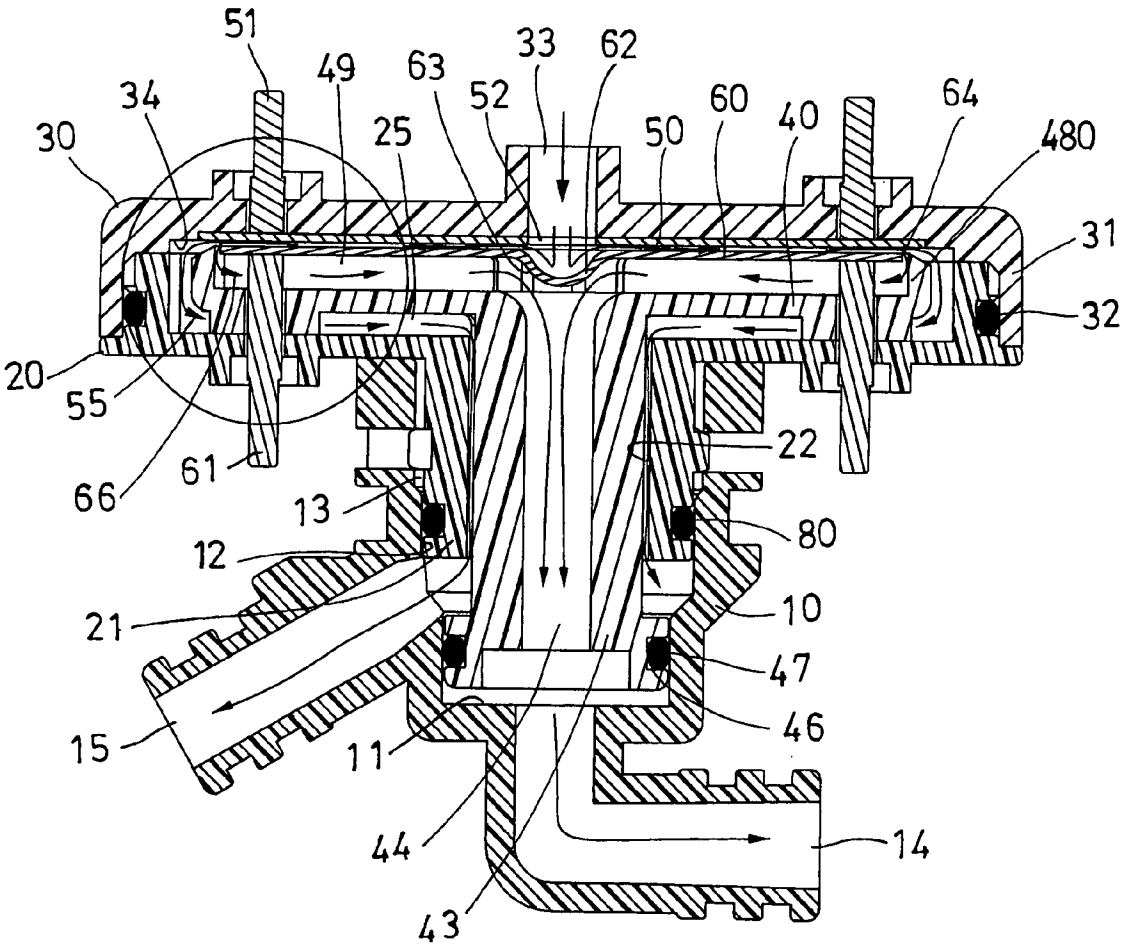
FIG. 12 is another cross sectional view similar to FIG. 11, illustrating the operation of the electrolytic cell or electrolyzer as shown in FIGS. 10 and 11.

In operation, as shown in FIG. 12, the electrolytic solution may be supplied and flown into the inlet mouth 33 of the cover 30 and through the center hole 52 of the anode plate 50 and then buffered and guided to flow through the gap 64 that is formed between the anode plate 50 and the cathode plate 60 by such as the recess 62 of the cathode plate 60. When the cathode plate 60 and the anode plate 50 are energized or actuated or operated, the catholyte 66 may be generated and attracted toward the cathode plate 60 and may thus be forced or attracted to flow closer to the cathode plate 60, and the anolyte 55 may be generated and attracted toward the anode plate 50 and may thus be forced or attracted to flow closer to the anode plate 50.

Figure 13:
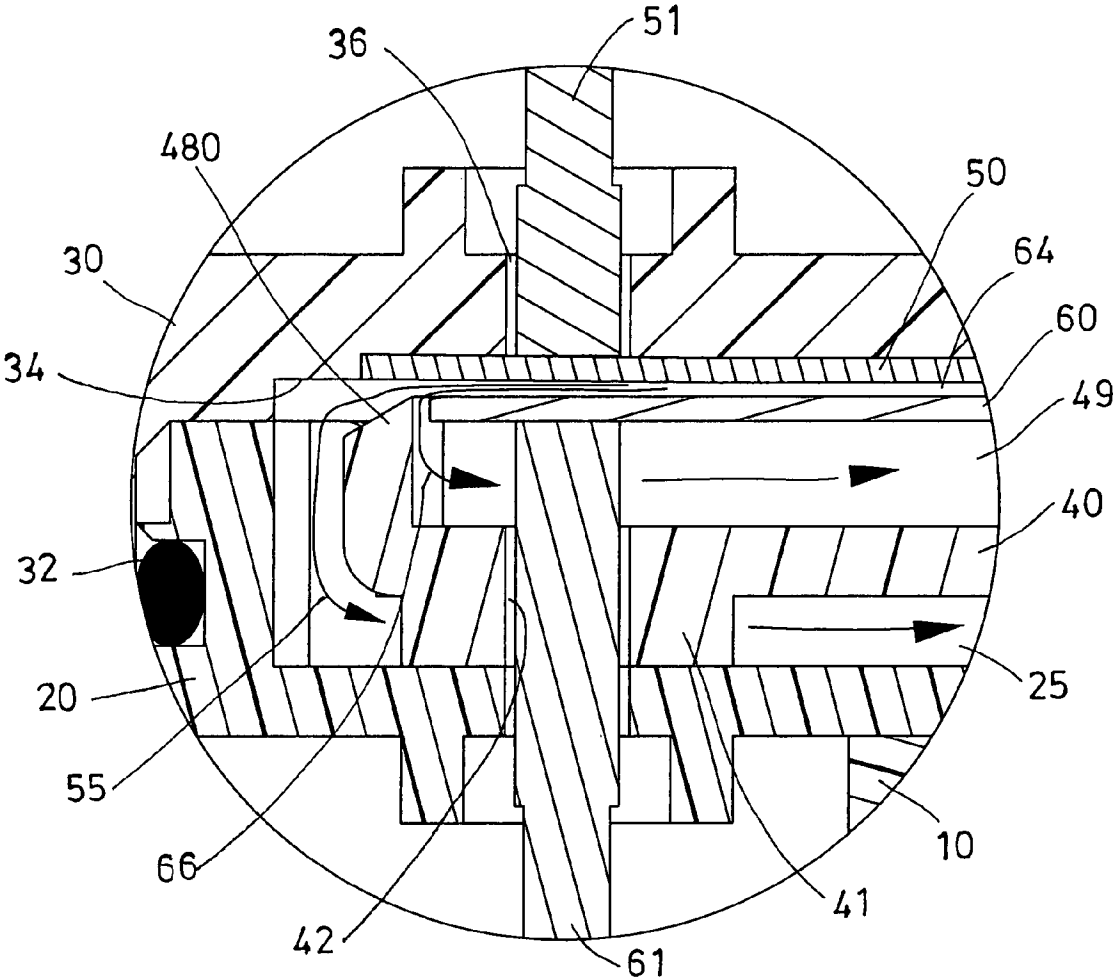
FIG. 13 is a partial cross sectional view of the electrolyzer.

The outer peripheral partition 480 of the distributor 40 may be provided for suitably separating the catholyte 66 and the anolyte 55 from each other and for preventing the catholyte 66 and the anolyte 55 from being mixed or blended with each other. In operation, as also shown in FIGS. 12 and 13, the catholyte 66 may be generated and attracted toward the cathode plate 60 and may thus be forced or caused or attracted to flow closer to the cathode plate 60, and may then be guided to flow into the compartment 48 of the distributor 40 by the cathode plate 60 itself and/or by the outer peripheral partition 480 of the distributor 40 and to flow through the passage 44 of the tube 43 or of the distributor 40, and may then be guided to flow out through the first or outlet port 14 of the receptacle 10, and then for allowing the catholyte 66 to be collected for further use.

Simultaneously, the anolyte 55 may be generated and attracted toward the anode plate 50 and may thus be forced or caused to flow closer to the anode plate 50, and may then be guided to flow into the space 23 of the housing 20 by the anode plate 50 itself and/or by the outer peripheral partition 480 of the distributor 40 and may then be guided to flow from the space 23 into the bore 22 of the cylindrical member 21 of the housing 20, and then to flow out of the receptacle 10 via the second or outlet port 15 of the receptacle 10, for allowing the anolyte 55 to be collected for further use.

The cathode plate 60 and the anode plate 50 may thus be used for generating the catholyte 66 and the anolyte 55 respectively, and for guiding the anolyte 55 to flow into the space 23 of the housing 20 and the bore 22 of the cylindrical member 21 and then to flow out through the second or outlet port 15 of the receptacle 10, and for guiding the catholyte 66 to flow into the compartment 48 of the distributor 40 and then to flow out through the first or outlet port 14 of the receptacle 10. The outer peripheral partition 480 of the distributor 40 may thus be acted as a separating means or device for separating the catholyte 66 and the anolyte 55 away from each other, and for effectively guiding the anolyte 55 and the catholyte 66 to flow into the space 23 of the housing 20 and the compartment 48 of the distributor 40 respectively.

It is to be noted that the typical electrolytic cells or electrolyzer failed to provide a cathode plate 60 and an anode plate 50 horizontally or one above the other, for allowing the electrolytic solution to be guided to flow radially through a gap that is formed between the anode plate 50 and the cathode plate 60, and for allowing the flowing speed of the electrolytic solution to be gradually decreased or slowed down from the center portions toward the outer peripheral portion of the anode plate 50 and the cathode plate 60 for preventing an eddy current from being generated between the anode plate 50 and the cathode plate 60.

Accordingly, the electrolyzer in accordance with the present invention may be provided for suitably separating and collecting the anolyte and the catholyte from the flowing electrolyte and for preventing the anolyte and the catholyte from being mixed or blended with each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electrolyzer comprising:

a housing including a space formed therein for receiving an electrolytic solution to be electrolyzed, and a cathode plate and an anode plate disposed in said space of said housing and disposed horizontally and arranged one above the other, and spaced from each other for forming a gap between said anode plate and said cathode plate, and arranged for guiding the electrolytic solution to flow radially through said gap formed between said anode plate and said cathode plate, and said cathode plate being provided for attracting catholyte of the electrolytic solution toward said cathode plate, and said anode plate being provided for attracting anolyte of the electrolytic solution toward said anode plate, and for allowing the anolyte and the catholyte to be separated from each other, and said anode plate and said cathode plate including an outer peripheral portion spaced away from each other for decreasing a flowing speed of the electrolytic solution.

2. The electrolyzer as claimed in claim 1 further comprising means for separating the anolyte and the catholyte from each other.

3. The electrolyzer as claimed in claim 2, wherein said separating means includes a separator disposed in said housing and disposed around said anode plate and said cathode plate, and having a tip extended toward said gap that is formed between said anode plate and said cathode plate for separating the anolyte and the catholyte from each other.

4. The electrolyzer as claimed in claim 3, wherein a cover is attached onto said housing for enclosing said space of said housing, and engaged with said separator for positioning said separator between said housing and said cover.

5. The electrolyzer as claimed in claim 4, wherein said housing includes a peripheral channel formed therein, said cover includes a peripheral fence extended therefrom and engaged into said peripheral channel of said housing for securing said cover to said housing.

6. The electrolyzer as claimed in claim 4, wherein said cover includes a mouth for allowing the electrolytic solution to flow into and out of said space of said housing, and includes a compartment formed therein and includes a plurality of ribs extended into said compartment of said cover and extended radially from said mouth toward an outer peripheral portion of said cover.

7. The electrolyzer as claimed in claim 1, wherein a distributor is disposed in said space of said housing, and said anode plate and said cathode plate are disposed above said distributor.

8. The electrolyzer as claimed in claim 7, wherein said distributor includes at least one stud extended downwardly therefrom for engaging with said housing and for spacing said distributor from said housing.

9. The electrolyzer as claimed in claim 1, wherein said anode plate is disposed below said cathode plate and includes a center hole formed therein for allowing the electrolytic solution to flow into said gap which is formed between said anode plate and said cathode plate.

10. An electrolyzer comprising:

a housing including a space formed therein for receiving an electrolytic solution to be electrolyzed, said housing including a cylindrical member extended downwardly therefrom and a bore formed therein and communicating with said space of said housing, a distributor disposed in said space of said housing, said distributor including a tube extended downwardly therefrom for engaging into said bore of said cylindrical member of said housing, and said tube including a passage formed therein for allowing the electrolytic solution to flow through said passage of said tube, and a cathode plate and an anode plate disposed in said space of said housing and disposed horizontally and arranged one above the other, and disposed above said distributor, and spaced from each other for forming a gap between said anode plate and said cathode plate, and arranged for guiding the electrolytic solution to flow radially through said gap formed between said anode plate and said cathode plate, and said cathode plate being provided for attracting catholyte of the electrolytic solution toward said cathode plate, and said anode plate being provided for attracting anolyte of the electrolytic solution toward said anode plate, and for allowing the anolyte and the catholyte to be separated from each other.

11. The electrolyzer as claimed in claim 10, wherein said housing includes a plurality of ribs extended into said space of said housing and extended radially and outwardly from said bore of said cylindrical member, and said anode plate is disposed above said ribs of said housing for spacing said distributor from said housing by said ribs.

12. The electrolyzer as claimed in claim 10, wherein said housing includes at least one orifice formed therein, and said distributor includes at least one hole formed therein and aligned with said at least one orifice of said housing, and said anode plate includes at least one electrode extended therefrom and engaged through said at least one hole of said distributor and said at least one orifice of said housing.

13. The electrolyzer as claimed in claim 10, wherein a receptacle includes a chamber formed therein and defined by an inner peripheral surface, and includes a first port and a second port formed therein and communicating with said chamber of said receptacle for allowing the electrolytic solution to flow into and out of said chamber of said receptacle, said cylindrical member of said housing and said tube of said distributor are engaged into said chamber of said receptacle.

14. The electrolyzer as claimed in claim 13, wherein said housing (distributor 40) includes a head provided on said tube and engaged into said chamber of said receptacle, and a sealing ring engaged between said head of said tube and said receptacle for making a water tight seal between said distributor and said receptacle, and for separating said first port and said second port of said receptacle from each other.

15. The electrolyzer as claimed in claim 13, wherein said receptacle includes at least one lock notch formed therein, and said housing includes at least one latch extended outwardly from said cylindrical member for engaging with said at least one lock notch of said receptacle and for detachably attaching said cylindrical member of said housing to said receptacle.

16. The electrolyzer as claimed in claim 10, wherein said distributor includes at least one spine extended outwardly from said tube for engaging with said cylindrical member and for spacing said tube of said distributor from said cylindrical member.

17. An electrolyzer comprising:

a housing including a space formed therein for receiving an electrolytic solution to be electrolyzed, and a cathode plate and an anode plate disposed in said space of said housing and disposed horizontally and arranged one above the other, and spaced from each other for forming a gap between said anode plate and said cathode plate, and arranged for guiding the electrolytic solution to flow radially through said gap formed between said anode plate and said cathode plate, and said anode plate being disposed below said cathode plate and including a center hole formed therein for allowing the electrolytic solution to flow into said gap which is formed between said anode plate and said cathode plate, said cathode plate being provided for attracting catholyte of the electrolytic solution toward said cathode plate, and said anode plate being provided for attracting anolyte of the electrolytic solution toward said anode plate, and for allowing the anolyte and the catholyte to be separated from each other, and said cathode plate including a recess formed therein and facing toward said center hole of said anode plate for buffering and guiding the electrolytic solution to flow through said gap which is formed between said anode plate and said cathode plate.

18. The electrolyzer as claimed in claim 17, wherein said cathode plate include a curved barrier to form said recess of said cathode plate.

* * * * *